US011307601B2

(12) United States Patent
Lumb

(10) Patent No.: US 11,307,601 B2
(45) Date of Patent: Apr. 19, 2022

(54) LINEAR VOLTAGE REGULATOR

(71) Applicant: Polaris Semiconductor LLC, Arlington, VA (US)

(72) Inventor: Matthew P. Lumb, Arlington, VA (US)

(73) Assignee: Polaris Semiconductor LLC, Arlington, VA (US)

( * ) Notice: Subject to any disclaimer, the term of this patent is extended or adjusted under 35 U.S.C. 154(b) by 0 days.

(21) Appl. No.: 17/198,738

(22) Filed: Mar. 11, 2021

(65) Prior Publication Data

US 2022/0091624 A1 Mar. 24, 2022

Related U.S. Application Data

(60) Provisional application No. 63/082,716, filed on Sep. 24, 2020.

(51) Int. Cl.
*G05F 1/575* (2006.01)
*H05B 45/395* (2020.01)
*H05B 45/375* (2020.01)

(52) U.S. Cl.
CPC ..... *G05F 1/575* (2013.01); *H05B 45/375* (2020.01); *H05B 45/395* (2020.01)

(58) Field of Classification Search
CPC ..... G05F 1/575; H05B 45/375; H05B 45/395
See application file for complete search history.

(56) References Cited

U.S. PATENT DOCUMENTS 3,617,859 A 11/1971 Dobkin et al.
3,826,930 A * 7/1974 Perry ..... H03K 19/14 326/14
3,867,580 A * 2/1975 Russell ..... H03K 19/14 375/257
4,275,404 A 6/1981 Cassiday et al.
4,673,864 A * 6/1987 Dessens ..... G05F 1/575 323/221

(Continued)

OTHER PUBLICATIONS

Wilkins et al., "Ripple-Free Boost-Mode Power Supply Using Photonic Power Conversion," IEEE Transactions on Power Electronics, vol. 34, No. 2, Feb. 2019; 11 pages.

(Continued)

*Primary Examiner* — Daniel D Chang
(74) *Attorney, Agent, or Firm* — Blank Rome LLP

(57) ABSTRACT

Disclosed is a linear voltage regulator with an input terminal, an output terminal, a pass device electrically connected to the input terminal and the output terminal, and an error amplifier that controls the output voltage at the output terminal by controlling the voltage drop across the pass device. The disclosed linear voltage regulator includes a light emitting section electrically connected in series with the pass device between the input terminal and the output terminal and a photovoltaic section, electrically connected to the output terminal, that receives photons emitted by the light emitting section and outputs a current to output terminal. The disclosed linear voltage regulator is more efficient than conventional linear voltage regulators because, unlike in those convention linear voltage regulators, the voltage drop across the pass device is only a fraction of the total potential difference between the input terminal and the output terminal.

20 Claims, 8 Drawing Sheets

(56) References Cited

U.S. PATENT DOCUMENTS

| | | | |
|---|---|---|---|
| 5,187,446 | A | 2/1993 | Daly |
| 5,189,307 | A | 2/1993 | Fabian |
| 5,659,204 | A | 8/1997 | Miller et al. |
| 5,753,928 | A | 5/1998 | Krause |
| 5,949,225 | A | 9/1999 | Sawtell |
| 6,188,212 | B1 | 2/2001 | Larson et al. |
| 7,800,037 | B2 | 9/2010 | Sawtell |
| 8,097,868 | B2 | 1/2012 | Monaco et al. |
| 8,674,681 | B2 | 3/2014 | Nanayakkara |
| 8,873,211 | B1 | 10/2014 | Butler |
| 8,934,267 | B2 | 1/2015 | He et al. |
| 9,647,162 | B2 | 5/2017 | Hodges |
| 2001/0033190 | A1 | 10/2001 | Bendall |
| 2009/0187925 | A1 | 7/2009 | Hu et al. |
| 2010/0225249 | A1 | 9/2010 | Liao et al. |
| 2011/0018590 | A1 | 1/2011 | Tai et al. |
| 2012/0192924 | A1 | 8/2012 | Basol |
| 2014/0015426 | A1 | 1/2014 | Kraft |
| 2016/0294385 | A1 | 10/2016 | Vazach et al. |
| 2017/0311396 | A1 | 10/2017 | Sadwick |
| 2018/0219625 | A1 | 8/2018 | Seki |
| 2018/0220502 | A1 | 8/2018 | Morales et al. |
| 2019/0335552 | A1 | 10/2019 | Iqbal et al. |
| 2020/0081472 | A1 | 3/2020 | Lumb |

OTHER PUBLICATIONS

"Voltage Regulation and Power Conversion," Art of Electronics Third Edition, 2015, pp. 594-613.

Toshiba TLP590B Photocoupler IRED & Photo-Diode Array, Toshiba Electronic Devices & Storage Corporation, Jun. 24, 2019; 6 pages.

* cited by examiner

LINEAR VOLTAGE REGULATOR

CROSS-REFERENCE TO RELATED APPLICATIONS

This application claims priority to U.S. Provisional Application No. 63/082,716, filed Sep. 24, 2020, which is hereby incorporated by reference.

FEDERAL FUNDING

This invention was made with government support awarded by the National Science Foundation (NSF) Small Business Innovation Research (SBIR) program phase I award number 1936401. The government has certain rights in the invention.

BACKGROUND

Linear voltage regulators are simple, low cost and compact components serving the purpose of converting a higher direct current (DC) voltage input to a lower DC voltage output, also known as "buck conversion." The linear voltage regulator circuit uses a feedback loop to regulate the output voltage, providing a stable, low noise output. A common use for linear voltage regulators is to regulate the voltage from a battery, where the input voltage varies depending on the state of charge and load across the battery (for example, 2.8-4.2 volts for a lithium-ion battery) but components require a stable DC level (for example, 1.8 volts in logic circuits). The drawback of linear voltage regulators for buck conversion is that the voltage difference between the input and output terminals is dropped across variable resistance and the associated electrical power is dissipated as waste heat. If the voltage difference between the input and output terminals is large, the efficiency of the linear voltage regulator is low as a significant amount of the power input is wasted as heat. The fundamental limit for the efficiency $\eta$ of a linear voltage regulator, neglecting any parasitic electrical losses, is related to the input voltage $V_{in}$ and output voltage $V_{out}$ by:

$$\eta = \frac{V_{out}}{V_{in}}.$$

Many applications, such as battery powered consumer electronics, require efficient DC-DC buck conversion to extend battery life and reduce heating due to power dissipation. Due to their high efficiency, switching regulators are usually preferred over linear voltage regulators in these applications. However, switching regulators are a source of conducted and radiated electromagnetic interference (EMI), which can cause problems in noise-sensitive circuits and components. Avoiding or suppressing EMI is important, particularly in demanding applications such as wideband radio frequency receivers, radar devices, and sensitive scientific instruments. Furthermore, switching regulators often require bulky additional components to operate, in addition to circuitry for filtering electrical noise associated with switching. These requirements add to footprint, complexity, and cost.

FIG. 1 is a block diagram illustrating a conventional linear voltage regulator 100.

As shown in FIG. 1, the conventional linear voltage regulator 100 includes an input terminal 101 in series with a pass device 130 and an output terminal 109. The function of the pass device 130 is provide a variable voltage drop to regulate the voltage at the output terminal 109. The voltage drop across the pass device 130 is controlled by an error amplifier 150. By controlling the voltage drop across the pass device 130, the error amplifier 150 allows the linear voltage regulator 100 to maintain a consistent output voltage at the output terminal 109 even as the input voltage and load current varies, provided the input voltage remains greater than the output voltage by an amount equal to or greater than the dropout voltage. (The dropout voltage of a linear regulator is the difference between the input and output voltages at which the circuit no longer regulates the output voltage with further reductions of input voltage.) One input to the error amplifier 150 is usually tied to a feedback network 180, which provides a scaled representation of the voltage at the output terminal 109. The error amplifier 150 compares the voltage from the feedback network 180 to a reference voltage supplied to a reference voltage terminal 105. The reference voltage can be generated in many ways without affecting the basic operation principle of the linear voltage regulator 100. The feedback network 180 is often a potential divider consisting of two resistors that connects the output terminal 109 and ground.

The pass device 130 typically includes a transistor (generally referred to as a "pass transistor"), such as a bipolar or field-effect transistor (FET). The pass device 130 may also consist of two or more coupled transistors.

FIG. 2 are diagrams illustrating conventional pass devices 130.

In one embodiment, the pass device 130*a* is a single NPN transistor 131. In another embodiment, the pass device 130*b* is a Darlington pair 132 of NPN transistors 131. In yet another embodiment, the pass device 130*c* includes a PMOS transistor 133 that acts as a pass transistor in series with the input terminal 101 and the output terminal 109 and a second transistor (in this example, an NPN transistor 134) that controls the gate of the PMOS pass transistor 133. In another embodiment, the pass device 130*d* includes a PNP transistor 135 that acts as a pass transistor in series with the input terminal 101 and the output terminal 109 and a second transistor (in this example, another PNP transistor 136) that controls the gate of the pass transistor 135.

The pass devices 130*a-d* shown in FIG. 2 is not an exhaustive list; other pass devices may be employed. The various possible combinations for the pass device 130 offer different advantages and drawbacks. However, all of the pass devices 130 function in basically the same manner: the voltage difference between the input terminal 101 and the output terminal 109 drops across the pass device 130 connected in series with the input terminal 101 and the output terminal 109.

U.S. Pat. Pub. No. 2020/0081472, which is hereby incorporated by reference, describes a linear voltage regulator circuit that is capable of DC up conversion and down conversion without switching, using a feedback voltage regulator circuit coupled with an optocoupler architecture.

FIG. 3 is a block diagram of a linear voltage regulator 300 described in U.S. Pat. Pub. No. 2020/0081472.

Like the conventional linear voltage regulator 100, the linear voltage regulator 300 includes an input terminal 101 coupled to a pass device 130. The voltage across the pass device 130 is controlled by an error amplifier 150. One input to the error amplifier 150 is tied to a feedback network 180, which provides a scaled representation of the voltage at an output terminal 109. In this embodiment, the feedback network 180 is a potential divider consisting of two resistors 182 and 184, which connects the output terminal 109 and ground. The resistors 182 and 184 may have a fixed resistance or an adjustable resistance. The error amplifier 150 compares the voltage from the feedback network 180 to a reference voltage supplied to a reference voltage terminal 105.

Unlike in a conventional linear voltage regulator 100, the pass device 130 is connected to a light emitting section 340 and a photovoltaic section 360 is connected to the input terminal 101 and output terminal 109. The light emitting section 340 may be, for example, an array of one or more light emitting diodes 342 or laser diodes. The light emitting diodes 342 may be connected in any combination of series and/or parallel strings. The photovoltaic section 360 may be, for example, an array of one or more photovoltaic devices 368. Similarly, the photovoltaic devices 368 may be connected in any combination of series and/or parallel strings.

The potential difference between the terminals of the light emitting section 340 generates photons. Photon transfer between the light emitting section 340 and the photovoltaic section 360 generates a photocurrent in the photovoltaic section 360. The illumination of the photovoltaic section 360 generates a potential difference between the terminals of the photovoltaic section 360, which can increase the voltage at the output terminal 109 relative to the input terminal 101, therefore achieving DC up-conversion.

SUMMARY

Disclosed is a linear voltage regulator with an input terminal for receiving an input voltage, an output terminal for outputting an output voltage, a pass device electrically connected to the input terminal and the output terminal, and an error amplifier that controls the output voltage by controlling the voltage drop across the pass device. The disclosed linear voltage regulator includes a light emitting section electrically connected in series with the pass device between the input terminal and the output terminal and a photovoltaic section, electrically connected to the output terminal, that receives photons emitted by the light emitting section and outputs a current to output terminal.

The disclosed linear voltage regulator is more efficient than conventional linear voltage regulators because, unlike in those convention linear voltage regulators, the voltage drop across the pass device is only a fraction of the total potential difference between the input terminal and the output terminal. The remainder of the voltage difference is drop across the light emitting section, which uses that voltage to generate photons. Those photons are received by the photovoltaic section and converted into a photocurrent that is supplied to the output terminal.

BRIEF DESCRIPTION OF THE DRAWINGS

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings.

DETAILED DESCRIPTION

Figure 1:
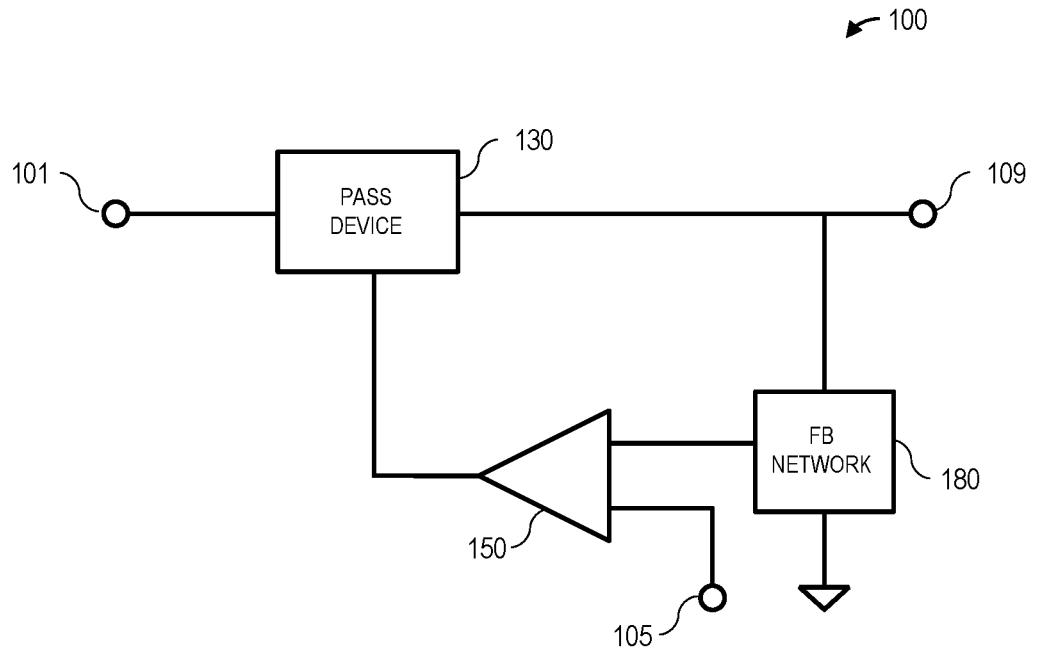
FIG. 1 (PRIOR ART)
FIG. 1 is a block diagram illustrating a conventional linear voltage regulator.
Figure 2:
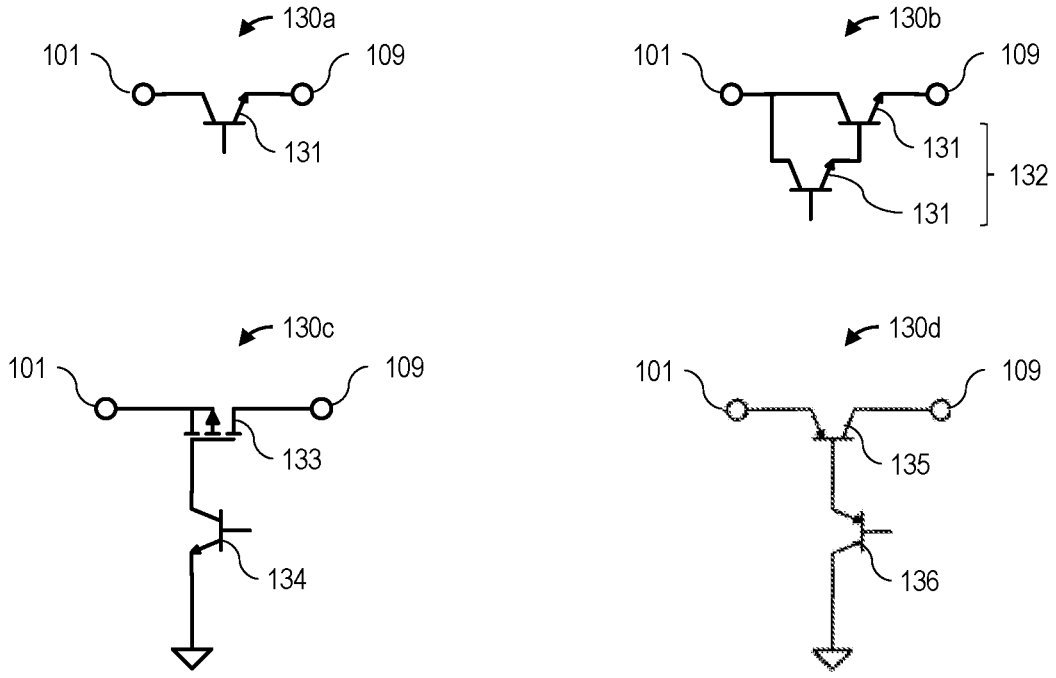
FIG. 2 (PRIOR ART)
FIG. 2 are diagrams illustrating conventional pass devices.
Figure 3:
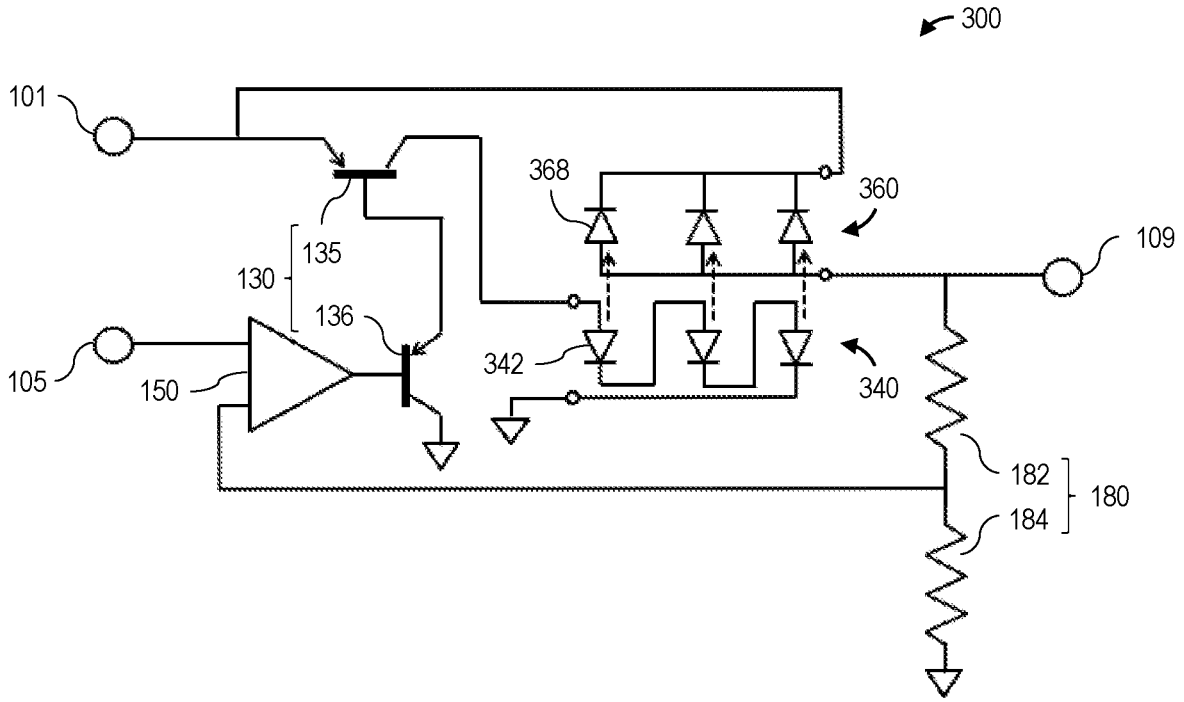
FIG. 3 (RELATED ART)
FIG. 3 is a block diagram of a linear voltage regulator with an optocoupler architecture, as described in U.S. Pat. Pub. No. 2020/0081472.

In describing the illustrative, non-limiting embodiments illustrated in the drawings, specific terminology will be resorted to for the sake of clarity. However, the disclosure is not intended to be limited to the specific terms so selected, and it is to be understood that each specific term includes all technical equivalents that operate in similar manner to accomplish a similar purpose. Several embodiments are described for illustrative purposes, it being understood that the description and claims are not limited to the illustrated embodiments and other embodiments not specifically shown in the drawings may also be within the scope of this disclosure.

Figure 4:
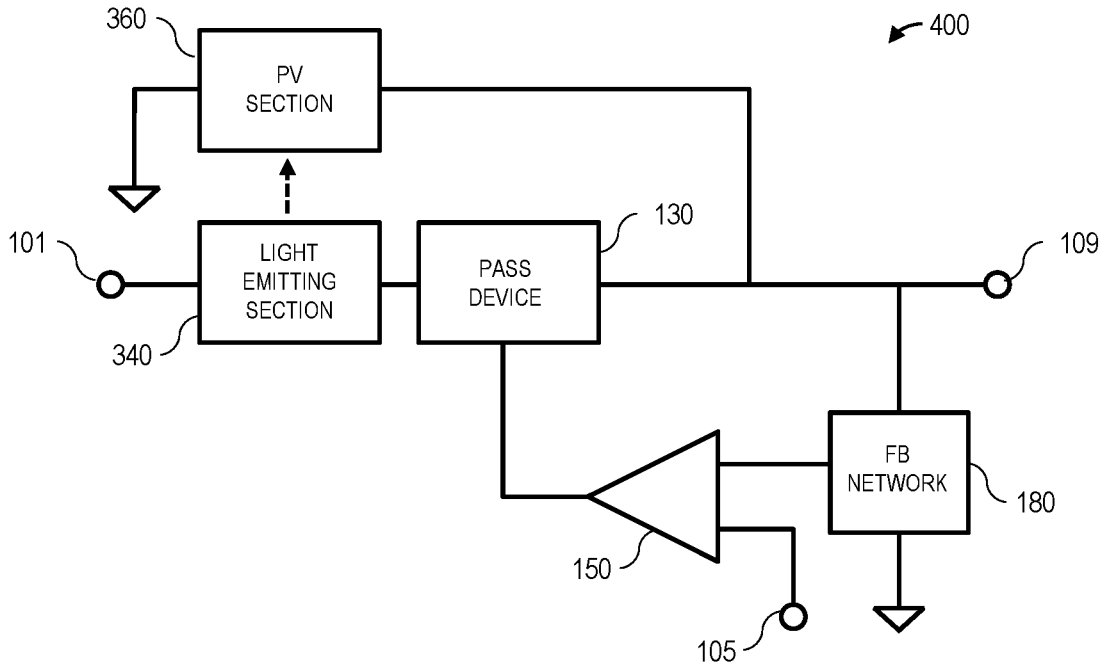
FIG. 4 is a block diagram illustrating a linear voltage regulator according to exemplary embodiments.

FIG. 4 is a block diagram illustrating a linear voltage regulator 400 according to exemplary embodiments.

Like the conventional linear voltage regulator 100, the linear voltage regulator 300 includes a pass device 130 connected in series with an input terminal 101 and an output terminal 109. The voltage across the pass device 130 is controlled by an error amplifier 150. One input to the error amplifier 150 is tied to a feedback network 180, which provides a scaled representation of the voltage at the output terminal 109. The error amplifier 150 compares the voltage from the feedback network 180 to a reference voltage supplied to a reference voltage terminal 105.

As shown in FIG. 4, the linear voltage regulator 400 also includes a light emitting section 340 connected in series with the pass device 130, the input terminal 101, and the output terminal 109. The linear voltage regulator 400 also includes a photovoltaic section 360, connected to the output terminal 109, that receives photons from the light emitting section 340.

The linear voltage regulator 400 achieves high efficiency in situations where there is a large voltage differences between the input terminal 101 and the output terminal 109. Like a conventional linear voltage regulator 100, a voltage drop across the pass device 130, controlled by the error amplifier 150, regulates the voltage provided to the output terminal 109. Unlike in a convention linear voltage regulator 100, however, the voltage drop across the pass device 130 of the linear voltage regulator 400 is only a fraction of the total potential difference between the input terminal 101 and the output terminal 109. The remainder of the voltage difference is drop across the light emitting section 340. The light emitting section 340 then transfers power via photon transfer to the photovoltaic section 360, which contributes to the current at the output terminal 109.

For example, in a conventional linear voltage regulator 100 with an input voltage of 5 V and an output voltage of 2 V, the pass device 130 will have a voltage drop of approximately 3 V (neglecting all other parasitic losses). In that example, the conventional linear voltage regulator 100 will have an efficiency upper limit of 40 percent. By contrast, if the linear voltage regulator 400 has an input voltage of 5 V, the forward voltage of the light emitting section 340 at the operating input current may be 2.8 V. In that instance, only 0.2 V is dropped across the pass device 130. The power supplied to light emitting section 340 generates photons that generate photocurrent in the photovoltaic section 360 via photon transfer. That photocurrent contributes to the current at the output terminal 109.

The light emitting section 340 (electrically connected in series with the pass device 130 between the input terminal 101 and the output terminal 109) and the photovoltaic section 360 (electrically connected to the output terminal 109) enable the linear voltage regulator 400 to operate with a higher efficiency than a conventional linear voltage regulator 100. For example, if the efficiency of the power transfer between the light emitting section 340 and the photovoltaic section 360 is 53.6 percent, the limiting efficiency for the linear voltage regulator 400 for an input voltage of 5 V (assuming an output voltage of 2 V and a forward voltage of 2.8 V for light emitting section 340 at the operating input current) would be 70 percent.

Unlike the linear voltage regulator 300 described in U.S. Pat. Pub. No. 2020/0081472, the light emitting section 340 of the linear voltage regulator 400 is connected in series with the input terminal 101, the output terminal 109, and the pass device 130. Meanwhile, the photovoltaic section 360 is electrically connected to the output terminal 109 and to ground. This configuration is distinct from the linear voltage regulator 300, where one terminal of the light emitting section 340 connects to ground instead of to the output terminal 109. In contrast to the linear voltage regulator 300 described in U.S. Pat. Pub. No. 2020/0081472, the linear voltage regulator 400 improves the efficiency of the buck conversion process by dramatically reducing the voltage drop across the pass device 130.

The light emitting section 340 may include an array of one or more light emitting diodes or laser diodes connected in any combination of series and/or parallel strings. Similarly, the photovoltaic section 360 may be an array of one or more photovoltaic devices connected in any combination of series and/or parallel strings. The light emitting section 340 and the photovoltaic section 360 may be realized as a single monolithic device, separate devices with a path for photons emitted by the light emitting section 340 to impinge on the surface of the photovoltaic section 360, or separate devices optically coupled through some other means (e.g., optical fibers).

The linear voltage regulator 400 may include other components in series with the light emitting section 340, such as resistors used to sense current. However, those components are omitted from FIG. 4 for clarity are not required to describe the operation of the example linear voltage regulator 400. Other common features of a linear voltage regulator circuit, such as capacitors for stability or circuitry for short circuit current protection, are also omitted for clarity.

All the components of linear voltage regulator 400 may be assembled in a single integrated circuit (IC) package using standard IC assembly processes. For example, the linear voltage regulator circuitry (e.g., the pass device 130, the error amplifier 150, etc.) may be co-packaged on a silicon-based IC chip with an optocoupler chip (containing, for example, the light emitting section 340 and the photovoltaic section 360) developed on a typical optoelectronic device platform, such as gallium arsenide (GaAs). The feedback network 180 and the source of the voltage reference can be built into the silicon-based IC, provided as separate components that are co-packaged with the linear voltage regulator circuitry and the optocoupler chip, or provided as separate components connected to the other circuit elements through the pins of the IC package. The entire linear voltage regulator 400 may also be fabricated on a single optoelectronic substrate (e.g., GaAs). The linear voltage regulator 400 can also be realized completely using separate packages, for example separate IC packages for voltage regulation, voltage reference and optocoupler sections. The circuit can also be composed partly or entirely of separate components—for example, separate pass device 130, error amplifier 150, light emitting section 340, and photovoltaic section 360. Separate components may be useful in high power applications, where high power devices with individual heatsinking may be advantageous.

FIGS. 5-15 are schematic diagrams of the linear voltage regulator 400 as embodied in various exemplary circuits 500-1500. In each instance, the linear voltage regulator 400 includes a pass device 130 (e.g., a PNP transistor 135 that acts as a pass transistor and a second PNP transistor 136 that controls the gate of the pass transistor 135) connected in series with an input terminal 101 and an output terminal 109. The voltage across the pass device 130 is controlled by an error amplifier 150, which compares a scaled representation of the voltage at the output terminal 109 received from a feedback network 180 (e.g., a potential divider consisting of two fixed-resistance or adjustable resistors 182 and 184) to a reference voltage supplied to a reference voltage terminal 105. In each embodiment, the photovoltaic section 360 is electrically connected to the output terminal 109 in parallel with the pass device 130.

Arrangement of the Pass Device 130 and the Light Emitting Section 340

Figure 5:
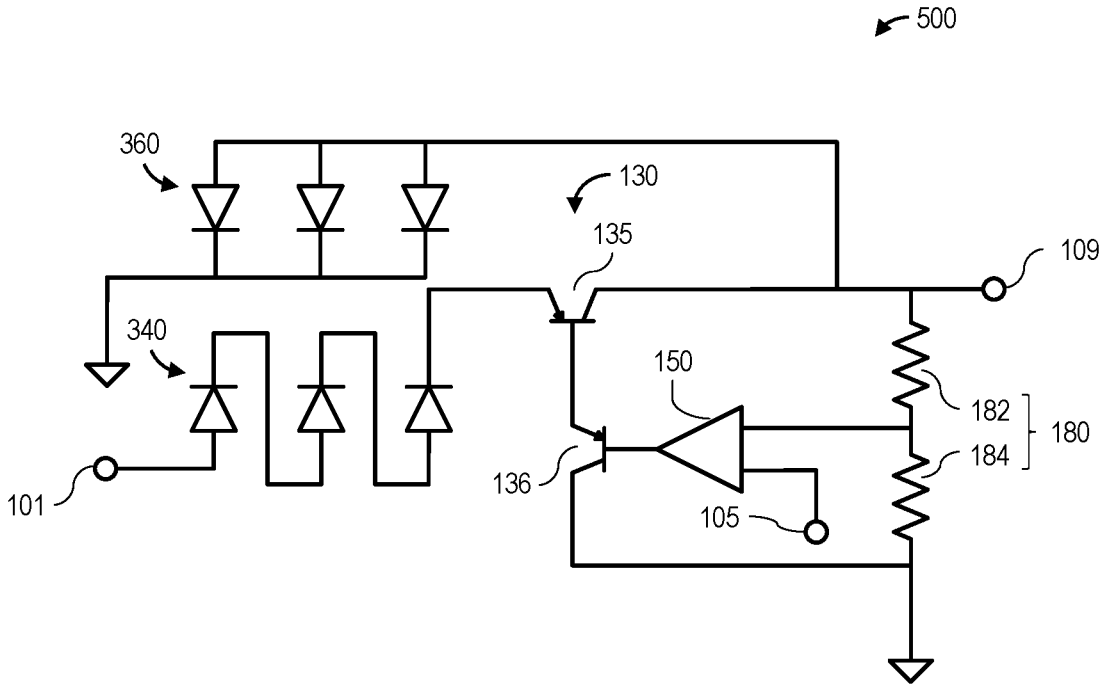
FIG. 5 is a schematic diagram of the linear voltage regulator of FIG. 4 as realized by an example linear voltage regulator circuit.

FIG. 5 is a schematic diagram of an example linear voltage regulator circuit 500 according to an exemplary embodiment.

In the example linear voltage regulator circuit 500 of FIG. 5, one terminal of the light emitting section 340 is coupled to the input terminal 101 and the other terminal of the light emitting section 340 is coupled to the pass device 130. In other words, the input terminal 101, the light emitting section 340, the pass device 130, and the output terminal 109 are electrically connected in series in that specific order.

Figure 6:
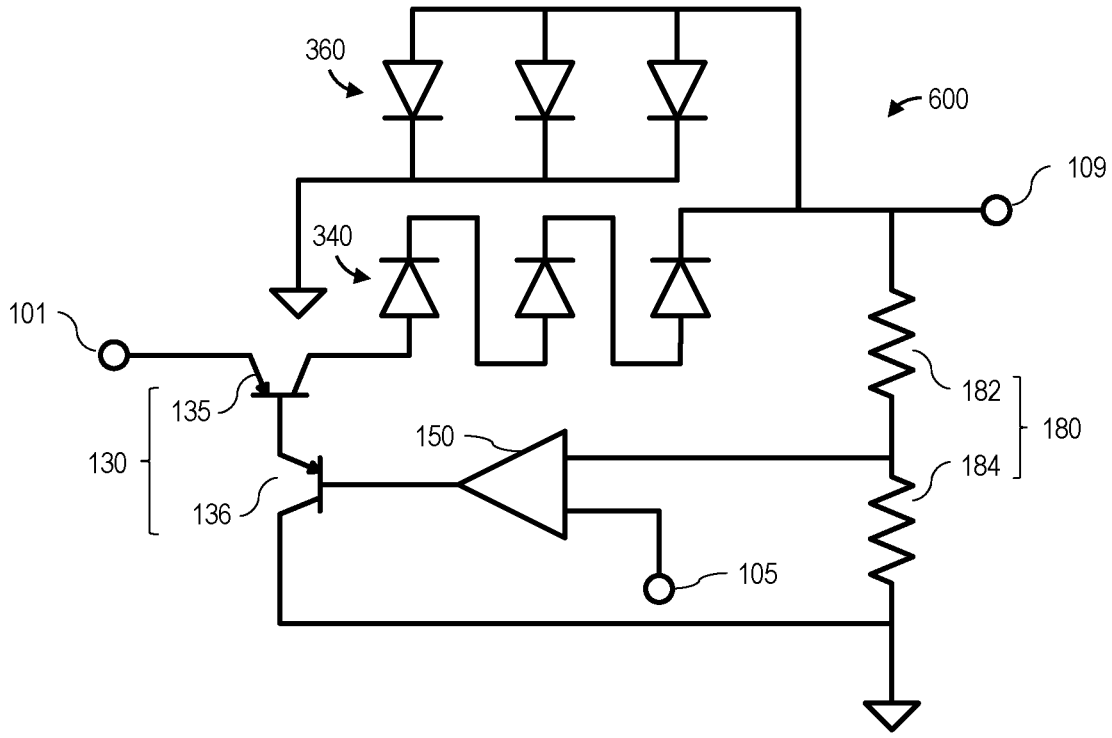
FIG. 6 is a schematic diagram of the linear voltage regulator of FIG. 4 as realized by another example linear voltage regulator circuit.

FIG. 6 is a schematic diagram of an example linear voltage regulator circuit 600 according to another exemplary embodiment.

In the example linear voltage regulator circuit 600 of FIG. 6, one terminal of the light emitting section 340 is coupled to the pass device 130 and the other terminal of the light emitting section 340 is coupled to the output terminal 109. In other words, the input terminal 101, the pass device 130, the light emitting section 340, and the output terminal 109 are electrically connected in series in that specific order. (As mentioned above, other components that may be electrically connected in series are omitted for clarity.)

Both of the linear voltage regulator circuits 500 and 600 improve the efficiency of the buck conversion, compared to the conventional linear voltage regulator 100, because a portion of the potential difference between the input terminal 101 and the output terminal 109 drops across the light emitting section 340.

Using Standard, Commercially Available Components

In each embodiment of the linear voltage regulator 400, the pass device 130, the error amplifier 150, and the supply of the reference voltage to the reference voltage terminal 105 may be implemented in a conventional manner. Therefore, in some embodiments, the linear voltage regulator 400 may be realized in part by incorporating standard, commercially available linear voltage regulator devices (e.g., an LT1963ET).

Figure 7:
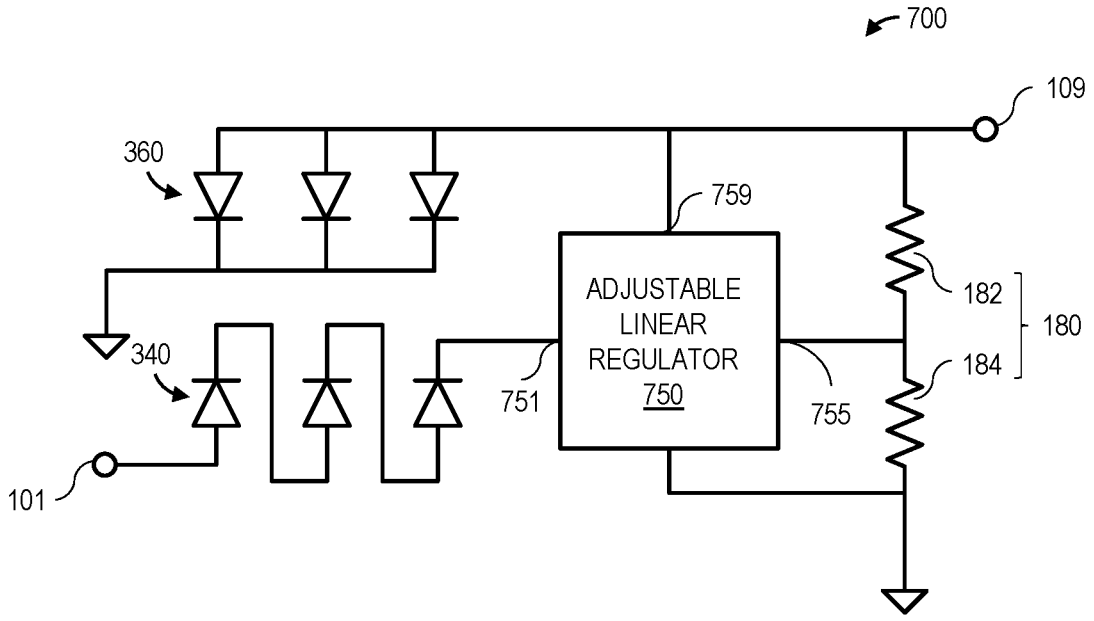
FIG. 7 is a schematic diagram of an example linear voltage regulator circuit with a standard adjustable linear voltage regulator according to an exemplary embodiment.

FIG. 7 is a schematic diagram of an example linear voltage regulator circuit 700 with a standard adjustable linear voltage regulator 750 according to an exemplary embodiment.

The adjustable linear voltage regulator 750 of FIG. 7 includes an input terminal 751, an output terminal 759, and an adjust terminal 755. Standard adjustable linear voltage regulators 750 include a pass device electrically connected between the input terminal 751 and the output terminal 759. Therefore, like other embodiments of the linear voltage regulator 400, the example linear voltage regulator circuit 700 includes a pass device electrically connected in series with the light emitting section 340 between the input terminal 101 and the output terminal 109. Standard adjustable linear voltage regulators 750 also include an error amplifier that controls the voltage drop across the pass device. To maintain a consistent voltage at the output terminal 109, the feedback network 180 (formed by the resistors 182 and 184) is connected to the adjust terminal 755. The adjustable linear voltage regulator 750 may contain a circuit for generating a reference voltage or may require an externally input reference voltage.

Figure 8:
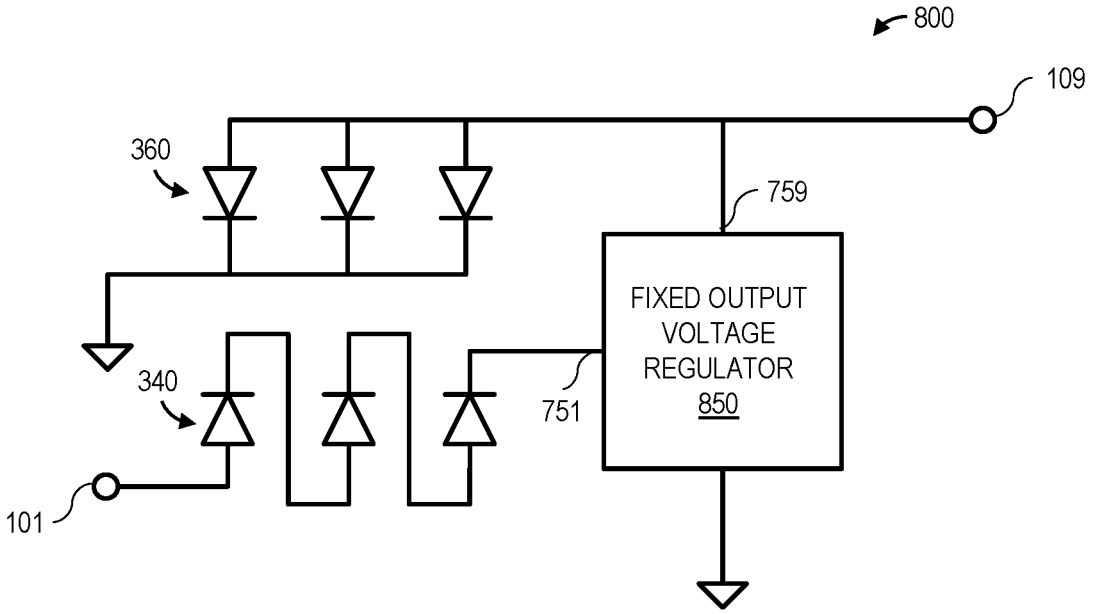
FIG. 8 is a schematic diagram of an example linear voltage regulator circuit with a standard fixed output voltage regulator according to an exemplary embodiment.

FIG. 8 is a schematic diagram of an example linear voltage regulator circuit 800 with a standard fixed output voltage regulator 850 according to an exemplary embodiment.

Like the standard adjustable linear voltage regulator 750, the standard fixed output voltage regulator 850 of FIG. 8 includes a pass device between an input terminal 751 and an output terminal 759 and an error amplifier that controls the voltage drop across the pass device. Unlike the adjustable linear voltage regulator 750, a feedback network 180 may be incorporated into the standard fixed output voltage regulator 850. Standard fixed output voltage regulator 850 also typically include a circuit for generating a reference voltage.

The ability to incorporate standard, commercially available linear voltage regulator devices (like a standard adjustable linear voltage regulator 750 or a standard fixed output voltage regulator 850) reduces the cost to produce the linear voltage regulator 400 while still providing the improving efficiency over a conventional linear voltage regulator 100. The adjustable linear voltage regulator 750 and the fixed output voltage regulator 850 may also include additional features, such as a shutdown terminal, which are omitted for clarity.

Bypassing the Light Emitting Section 340

Figure 9:
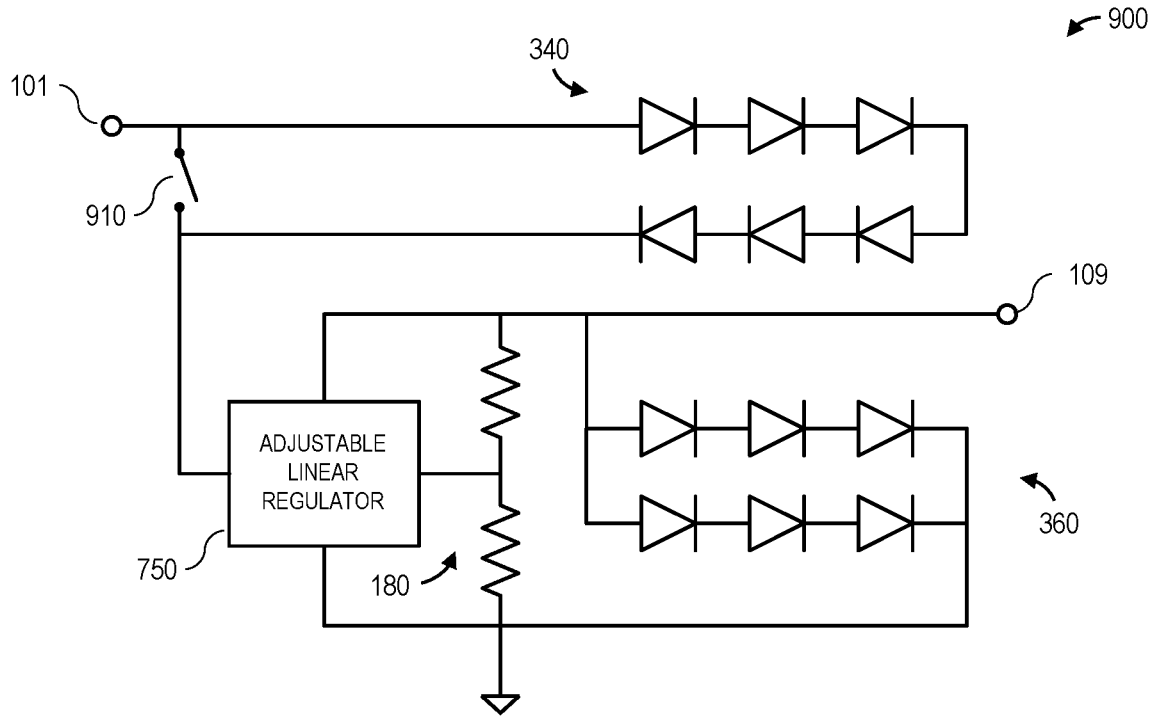
FIG. 9 is a schematic diagram of an example linear voltage regulator circuit that includes a switching device for bypassing the light emitting section according to an exemplary embodiment.

FIG. 9 is a schematic diagram of an example linear voltage regulator circuit 900 that includes a switching device 910 according to an exemplary embodiment.

When the switching device 910 is closed, the light emitting section 340 is bypassed and the example linear voltage regulator circuit 900 operates more like a conventional linear voltage regulator 100. Having the option to bypass the light emitting section 340 is useful in situations where a wide input voltage range is provided. For example, a device producing a 5 V output may be required to operate as a standard linear voltage regulator for input voltages between 5 V and 9 V and with high efficiency (via the light emitting section 340 and the photovoltaic section 360) for input voltages exceeding 9 V. Therefore, the linear voltage regulator circuit 900 may operate with the switching device 910 closed when the input voltage at the input terminal 101 is between 5 V and 9 V and with the switching device 910 open when the input voltage at the input terminal 101 exceeds 9 V. For example, a voltage-controlled switch could be employed that senses the input voltage $V_{in}$ at the input terminal 101, closes the switching device 910 if the input voltage $V_{in}$ is less than 9 V, and opens the switching device 910 otherwise. The voltage control may be based on the input voltage $V_{in}$ or the switching device 910 may be controlled by a separate voltage input from an external controller.

Figure 10:
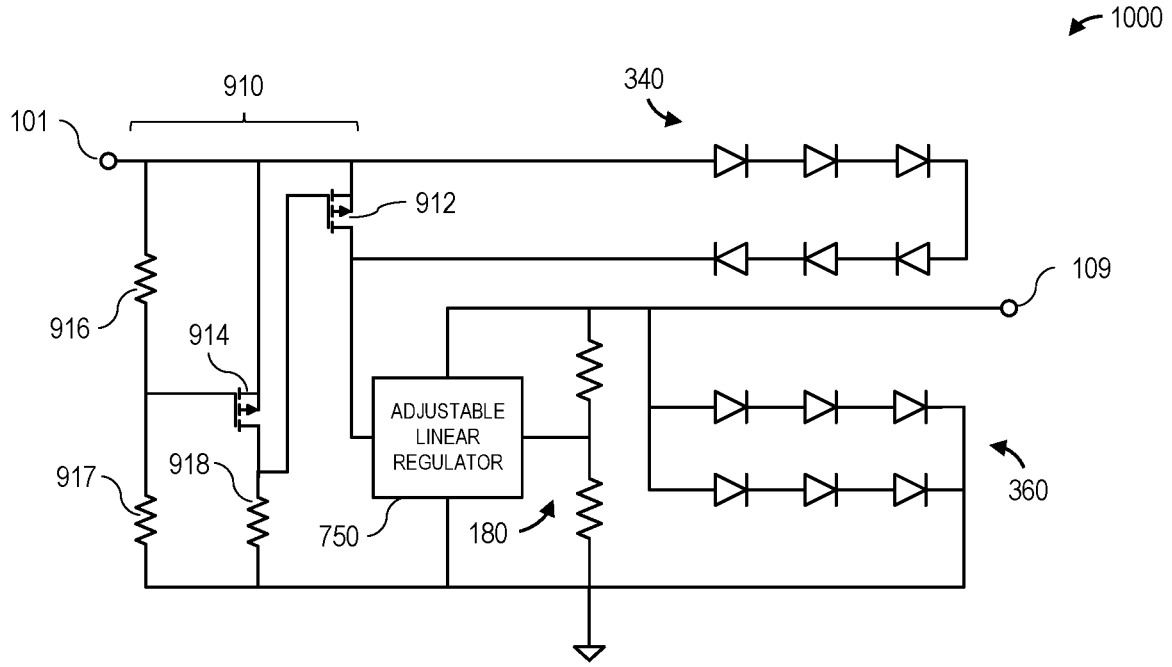
FIG. 10 is a schematic diagram of an example linear voltage regulator circuit with an example switching device for bypassing the light emitting section according to an exemplary embodiment.

FIG. 10 is a schematic diagram of a linear voltage regulator circuit 1000 with an example switching device 910 according to an exemplary embodiment.

As shown in FIG. 10, the switching device 910 may include a combination of p-channel MOSFET transistors. The switching device 910 may generated a scaled representation of the input voltage $V_{in}$, compare that scaled representation to a threshold, and causes current received at the input terminal to bypass the light emitting section based on that scaled representation of the input voltage $V_{in}$.

As shown in FIG. 10, for example, a transistor 912 acts as a bypass to the light emitting section 340. A transistor 914 controls the gate of the transistor 912. The transistor 914 is resistive for $V_G - V_{in} > V_{th}$, where $V_G$ is the gate voltage of the transistor 914, $V_{in}$ is in the input voltage at the input terminal 101, and $V_{th}$ is the threshold voltage of transistor 914. The magnitude voltage $V_G$ at the gate of the transistor 914 relative to the input voltage $V_{in}$ is controlled by the resistors 916 and 917. When transistor 914 is resistive (i.e., in an off state), for the appropriate choice of resistor 918, the gate voltage of the transistor 912 is low compared to $V_{in}$ and transistor 912 has a low resistance (corresponding to the switch closed state). At higher input voltage $V_{tin}$, the transistor 914 becomes conductive (i.e., in an on state) as $V_G - V_{in} > V_{th}$, which pulls the gate voltage of the transistor 912 close to $V_{in}$. When the gate voltage of the transistor 912 is close to $V_{in}$, the transistor 914 becomes resistive (corresponding to an open state) and the input power passes through the light emitting section 340.

Bypassing the Photovoltaic Section 360

Figure 11:
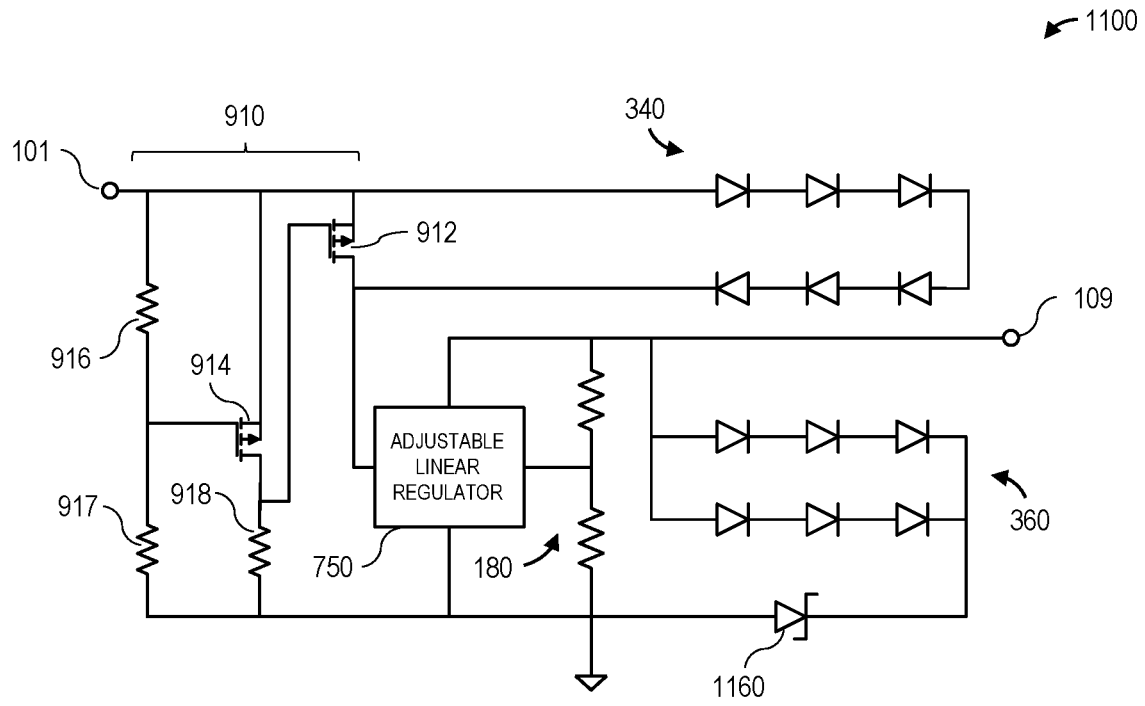
FIG. 11 is a schematic diagram of a linear voltage regulator circuit with a diode for bypassing the photovoltaic section according to an exemplary embodiment.

FIG. 11 is a schematic diagram of a linear voltage regulator circuit 1100 with a diode 1160 in series with the photovoltaic section 360 according to an exemplary embodiment.

As shown in FIG. 11, the diode 1160 may be a low forward drop Schottky diode. When the light emitting section 340 is not producing light, the Schottky diode 1160 prevents parasitic current flow through the photovoltaic section 360.

Figure 12:
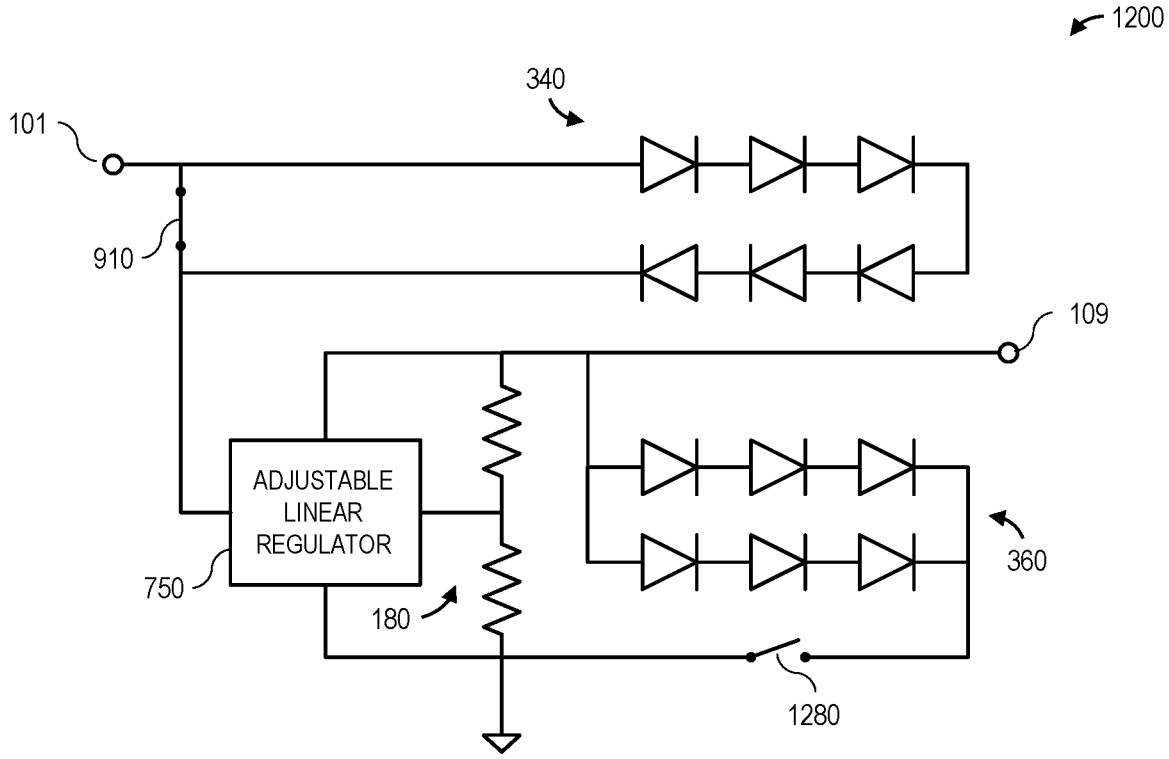
FIG. 12 is a schematic diagram of a linear voltage regulator circuit with a switch for bypassing the photovoltaic section according to an exemplary embodiment.

FIG. 12 is a schematic diagram of a linear voltage regulator circuit 1200 with a switch 1260 in series with the photovoltaic section 360 according to an exemplary embodiment.

The switch 1260 may be realized, for example, using a transistor. Similar to the diode 1160, the switch 1260 controls the current flow through the photovoltaic section 360. For example, in light load situations with low output current at the output terminal 109 and the switch 1260 closed, current can flow through the forward-biased photovoltaic section 360 and cause excessive current consumption at the input terminal 109. When desired, the switch 1260 can block current flow through the photovoltaic section 360. The linear voltage regulator circuit 1200 has the added advantage of a significantly lower voltage drop across the switch 1260 when closed compared to the Schottky diode 1160 of the linear voltage regulator circuit 1100.

Bypassing Portions of the Light Emitting Section 340

Bypass switches can also be used to bypass portions of the light emitting section 340.

Figure 13:
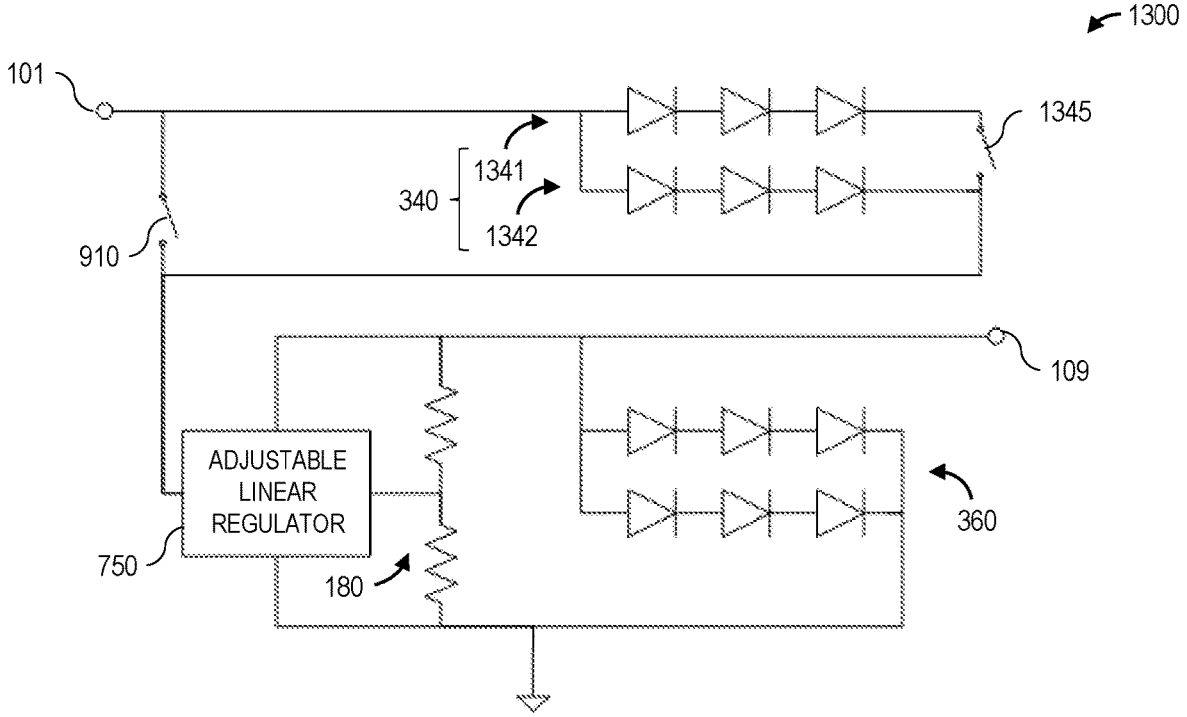
FIG. 13 is a schematic diagram of a linear voltage regulator circuit with a switch for bypassing a portion of the light emitting section according to an exemplary embodiment.

FIG. 13 is a schematic diagram of a linear voltage regulator circuit 1300 with a switch 1345 that bypasses a portion of the light emitting section 340 according to an exemplary embodiment.

As briefly mentioned above, the light emitting section 340 may include light emitting devices arranged in any combination of parallel and/or series. As shown in FIG. 13, the light emitting section 340 may be parallel strings 1341 and 1342 of light emitting devices connected in series. The switch 1345 bypasses a portion of the light emitting section 340. When the switch 1345 is closed, current flows though both of the strings 1341 and 1342. When the switch 1345 is open, the string 1341 is bypassed.

Figure 14:
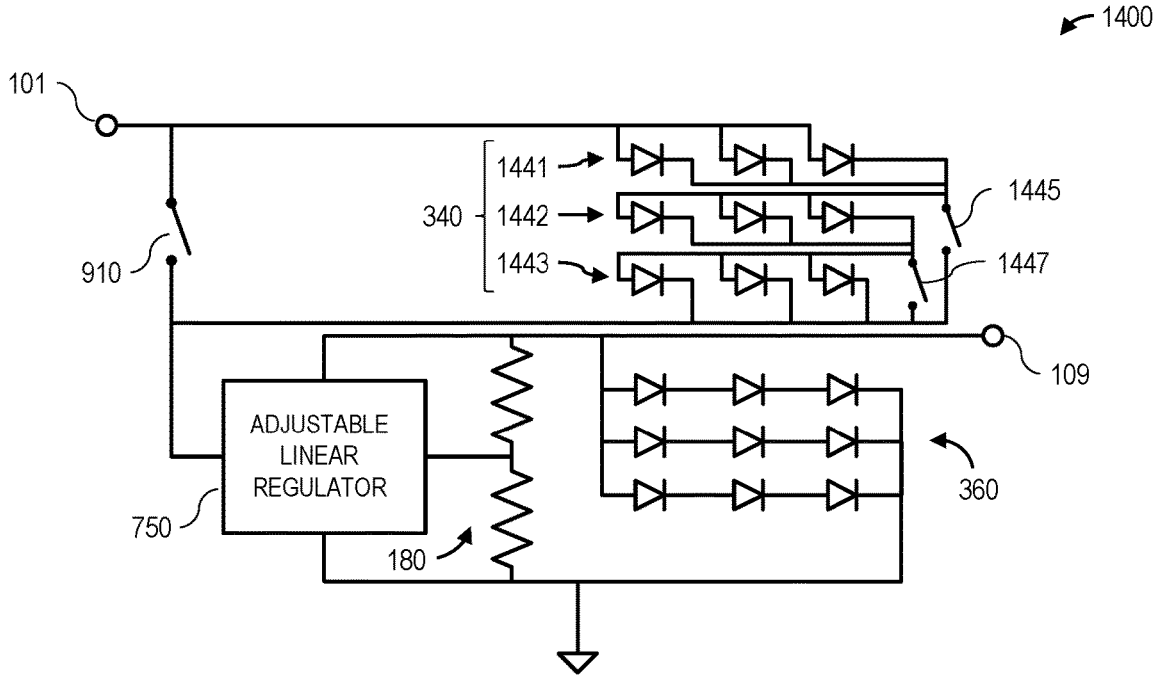
FIG. 14 is a schematic diagram of a linear voltage regulator circuit with switches for bypassing portions of the light emitting section according to an exemplary embodiment.

FIG. 14 is a schematic diagram of a linear voltage regulator circuit 1400 with a switches 1445 and 1447 that each bypasses a portion of the light emitting section 340 according to an exemplary embodiment.

As shown in FIG. 14, the light emitting section 340 may be a series of strings 1441, 1442, and 1443 of light emitting devices connected in parallel. Each switch 1445 and 1447 provides functionality to bypass one or more of the strings 1442 and 1443. For instance, closing the switch 1445 bypasses the strings 1442 and 1443. Opening the switch 1445 and closing the switch 1447 bypasses only the string 1443. When both of the switches 1445 and 1447 are open, none of the strings are bypassed and current flows though all three of the strings 1441, 1442, and 1443.

Each of the switches 1345, 1445, and 1147 may be realized using transistors, which may open and close depending on the input voltage at the input terminal 101 or may be controlled by an external controller. A primary reason for bypassing a portion of the light emitting section 340 is to improve efficiency under light load conditions when the current provided to the output terminal 109 is low. Blocking the flow of input current to a portion of the emitting section 340 increases the current density in the remaining portions of the emitting section 340, which improves the efficiency of the optocoupler.

Figure 15:
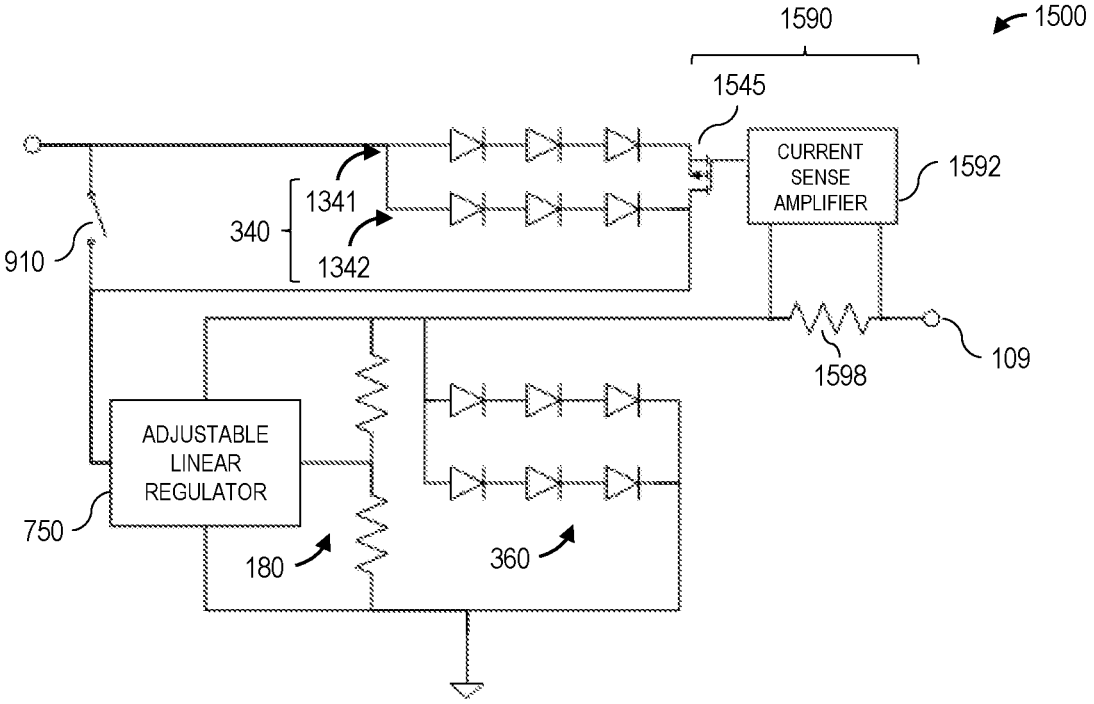
FIG. 15 is a schematic diagram of a linear voltage regulator circuit with a controller that bypasses a portion of the light emitting section based on the current at the output terminal according to an exemplary embodiment.

FIG. 15 is a schematic diagram of a linear voltage regulator circuit 1500 with a controller 1590 that bypasses a portion of the light emitting section 340 based on the current at the output terminal 109 according to an exemplary embodiment.

Like the light emitting section 340 of the linear voltage regulator circuit 1300 of FIG. 13, the light emitting section 340 of the linear voltage regulator circuit 1500 may be parallel strings 1341 and 1342 of light emitting devices connected in series. The string 1341 may be bypassed when a transistor 1545, which is in series with the string 1341, is open. A current sense amplifier 1592 measures the current at the output terminal 109 across a sense resistor 1598 and controls the gate of transistor 1545. When the current supplied to the output terminal 109 drops below a predetermined threshold, the current sense amplifier 1598 causes the transistor 1545 to become resistive, causing most of the current in the light emitting section 340 to pass through the string 1342.

CONCLUSION

Throughout this specification, this disclosure describes electrical components being "coupled" or "electrically connected." As used herein, the term "coupled" or the phrase "electrically connected" is used to describe both direct electrical connections and indirect electrical connections via intermediate electrical components, which may be omitted from this description for clarity.

The foregoing description and drawings should be considered as illustrative only of the principles of the disclosure, which may be configured in a variety of shapes and sizes and is not intended to be limited by the embodiment herein described. Numerous applications of the disclosure will readily occur to those skilled in the art. Therefore, it is not desired to limit the disclosure to the specific examples disclosed or the exact construction and operation shown and described. Rather, all suitable modifications and equivalents may be resorted to, falling within the scope of the disclosure.

What is claimed is:

1. A linear voltage regulator, comprising:

an input terminal for receiving an input voltage;

an output terminal for outputting an output voltage;

a pass device electrically connected to the input terminal and the output terminal;

an error amplifier that controls the output voltage by controlling the voltage drop across the pass device;

a light emitting section, electrically connected in series with the pass device between the input terminal and the output terminal, that emits photons; and a photovoltaic section, electrically connected to the output terminal, that receives photons emitted by the light emitting section and outputs a current to output terminal.

2. The linear voltage regulator of claim 1, wherein the light emitting section includes a first terminal electrically connected to the input terminal and a second terminal electrically connected to the pass device.

3. The linear voltage regulator of claim 1, wherein the light emitting section includes a first terminal electrically connected to the pass device and a second terminal electrically connected to the output terminal.

4. The linear voltage regulator of claim 1, further comprising:

a switching device that provides functionality for current received at the input terminal to bypass the light emitting section.

5. The linear voltage regulator of claim 4, wherein the switching device compares a scaled representation of the input voltage to a threshold and causes current received at the input terminal to bypass the light emitting section in response to the comparison.

6. The linear voltage regulator of claim 1, further comprising:

a mechanism that provides functionality to block current flow through the photovoltaic section.

7. The linear voltage regulator of claim 1, wherein the light emitting section comprises a plurality of light emitting portions, the linear voltage regulator further comprising:

a switch that provides functionality for current received by the input terminal to bypass one or more of the light emitting portions of the light emitting section.

8. The linear voltage regulator of claim 7, further comprising:

a controller that measures current at the output terminal, compares the current at the output terminal to a threshold, and causes current received by the input terminal to bypass one or more of the light emitting portions of the light emitting section in response to the comparison.

9. The linear voltage regulator of claim 1, wherein the error amplifier compares a scaled representation of the output voltage received from a feedback network to a reference voltage.

10. The linear voltage regulator of claim 9, wherein the feedback network is a potential divider comprising two resistors.

11. A method of making a linear voltage regulator, the method comprising:

providing an input terminal for receiving an input voltage;

providing an output terminal for outputting an output voltage;

electrically connecting a pass device to the input terminal and the output terminal;

electrically connecting an error amplifier to the pass device, the error amplifier being configured to control the output voltage by controlling the voltage drop across the pass device;

electrically connecting a light emitting section in series with the pass device between the input terminal and the output terminal, that emits photons; and electrically connecting a photovoltaic section to the output terminal, the photovoltaic section being configured to receive photons emitted by the light emitting section and output a current to output terminal.

12. The method of claim 11, wherein electrically connecting the light emitting section in series with the pass device comprises electrically connecting a first terminal of the light emitting section to the input terminal and electrically connecting a second terminal of the light emitting section to the pass device.

13. The method of claim 11, wherein electrically connecting the light emitting section in series with the pass device comprises electrically connecting a first terminal of the light emitting section to the pass device and electrically connecting a second terminal of the light emitting section to the output terminal.

14. The method of claim 11, further comprising:

electrically connecting a switching device to the light emitting section that provides functionality for current received at the input terminal to bypass the light emitting section.

15. The method of claim 14, wherein the switching device compares a scaled representation of the input voltage to a threshold and causes current received at the input terminal to bypass the light emitting section in response to the comparison.

16. The method of claim 11, further comprising:

electrically connecting a mechanism photovoltaic section that provides functionality to block current flow through the photovoltaic section.

17. The method of claim 11, wherein the light emitting section comprises a plurality of light emitting portions, the method further comprising:

electrically connecting a switch to the light emitting section that provides functionality for current received by the input terminal to bypass one or more of the light emitting portions of the light emitting section.

18. The method of claim 17, further comprising:

electrically connecting a controller to the switch that measures current at the output terminal, compares the current at the output terminal to a threshold, and operates the switch to cause current received by the input terminal to bypass one or more of the light emitting portions of the light emitting section in response to the comparison.

19. The method of claim 11, wherein the error amplifier compares a scaled representation of the output voltage received from a feedback network to a reference voltage.

20. The method of claim 19, wherein the feedback network is a potential divider comprising two resistors.

* * * * *